United States Patent [19]

Zaruba

[11] Patent Number: 4,941,859

[45] Date of Patent: Jul. 17, 1990

[54] TOWN PLAYSET

[75] Inventor: John V. Zaruba, Chicago, Ill.

[73] Assignee: Marvin Glass & Associates, Chicago, Ill.

[21] Appl. No.: 303,610

[22] Filed: Jan. 26, 1989

[51] Int. Cl.[5] ..... A63H 3/52; A63H 3/00; A63H 33/08

[52] U.S. Cl. ..... 446/476; 446/72; 446/110

[58] Field of Search ..... 446/475, 476, 478, 479, 446/480, 481, 482, 487, 82, 83, 71, 72, 75, 76, 296, 110, 109, 108, 85, 69, 70

[56] References Cited

U.S. PATENT DOCUMENTS

| | | | |
|---|---|---|---|
| Re. 18,738 | 2/1933 | Gilmond | 446/476 |
| 3,363,360 | 1/1968 | Ryan | 446/478 |
| 3,614,840 | 10/1971 | Vadell | 446/82 X |
| 4,094,090 | 6/1978 | Walmer | 446/110 |
| 4,107,869 | 8/1978 | Abrams | 446/110 |
| 4,342,173 | 8/1982 | Otake | 446/487 X |
| 4,536,162 | 8/1985 | Ace, Jr. | 446/115 X |
| 4,696,652 | 9/1987 | Reeder | 446/478 X |

FOREIGN PATENT DOCUMENTS

| | | | |
|---|---|---|---|
| 2818697 | 10/1979 | Fed. Rep. of Germany | 446/476 |

*Primary Examiner*—Robert A. Hafer
*Assistant Examiner*—D. Neal Muir
*Attorney, Agent, or Firm*—John S. Pacocha

[57] ABSTRACT

A playset including various building facades representing a food store, pet shop, florist, post office, bank and the like have both exterior and interior details with various movable play features. Additional town structures such as mailboxes, benches, lampposts, fences and the like are used between the building facades to connect the facades with each other. Also included with the playset is a line of small, soft body dolls and animal figures representing various family members, town officials and pets.

5 Claims, 1 Drawing Sheet

10
12
14
16
18
20
22
24
26
28
30
32
34
38
38a
38b
38c
40
40a
40b
40c
42
42b
42c
44
46
50
52
54
56
58
60
62

TOWN PLAYSET

BACKGROUND OF THE INVENTION

1. Field of the Invention

This invention relates generally to children's playsets and more particularly to a playset having connectable building facades.

2. Background Art

Playsets featuring a building or vehicle are old in the art. For examples, U.S. Pat. No. 4,030,234 issued June 21, 1977 to Allen et al. shows a playset featuring a hexagonal gazebo with six fold down side panels that have play items secured to their inside surface. In U.S. Pat. No. 4,030,235 issued June 21, 1977 to Terzian et al., the playset is in the form of a hospital vehicle, the hinged halves of which open to expose various simulated pet care devices. U.S. Pat. No. 4,139,967 issued Feb. 20, 1987 to Kuna et al., discloses a simulated castle playset includes a pair of mating hollow housing members hingedly attached together; when open, the housing members expose various areas and devices for play with characters that accompany the playset. Although not exactly a playset, U.S. Pat. No. 4,435,915 issued Mar. 13, 1984 to Zaruba et al. discloses a multiwindowed collapsible doll house for displaying and storing toy dolls that is intended to be mounted on a wall or similar structure with the dolls exposed to view through the windows of the facade of the house. There remains, however, a need for a playset with individual but connectable building facades for simulating play in an entire town or the like.

SUMMARY OF THE INVENTION

The present invention is concerned with providing a playset with a plurality of individual building facades representing various town buildings such as a food store, pet shop, florist, post office, bank and the like having both exterior and interior details with various movable play features. Additional town structures such as mailboxes, benches, lampposts, fences and the like are used to connect the buildings. In addition to the buildings, a line of small, soft body dolls representing various family members, town officials, and the like are included in the playset.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figures 1, 2, 3:
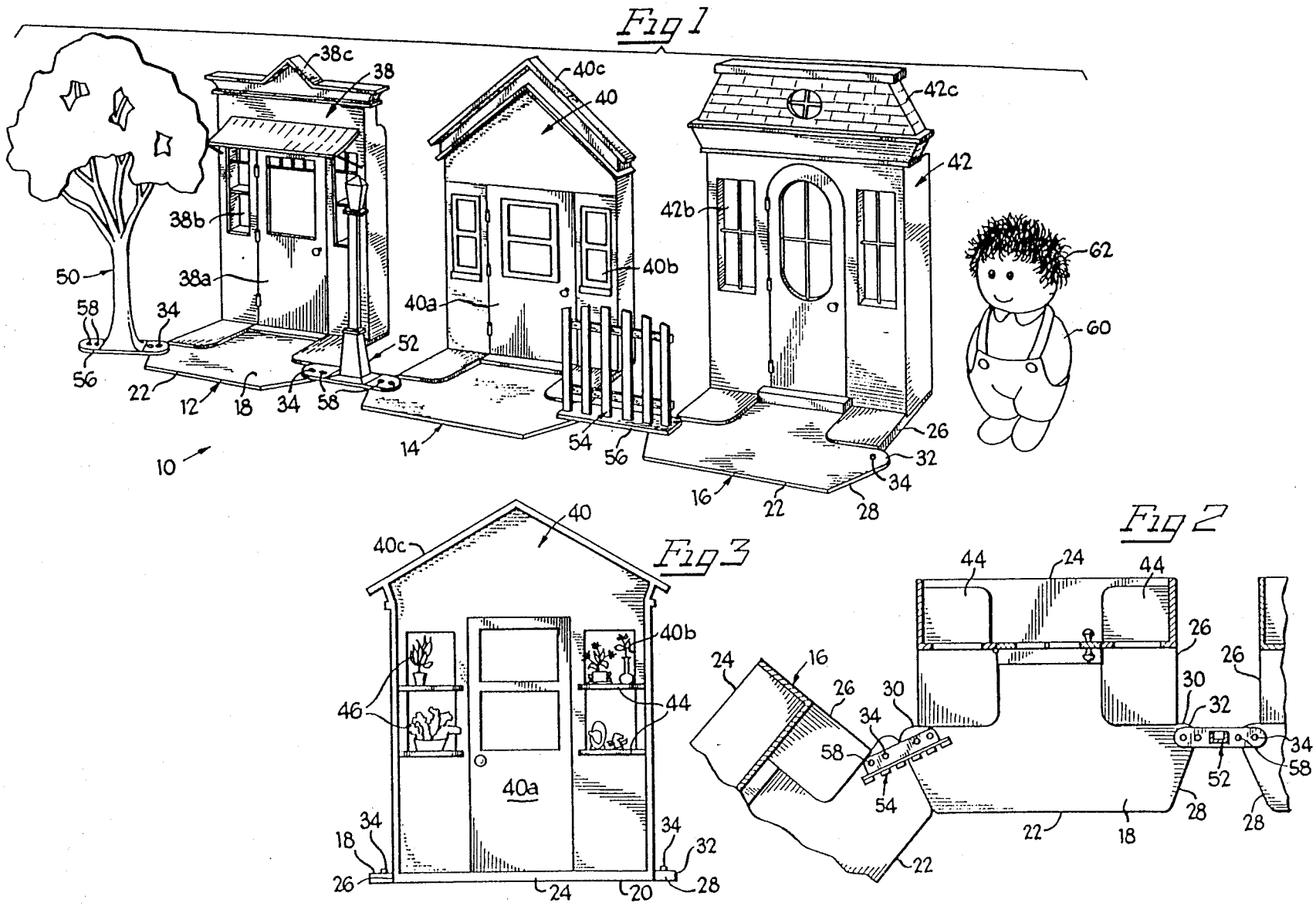
FIG. 1 is a perspective view of an embodiment of the present invention.
FIG. 2 is a fragmentary, top sectional view of an alternate arrangement.
FIG. 3 is a rear plan view of one of the toy buildings shown in FIG. 1.

Referring now to the drawings in which like parts are designated by like reference numerals throughout the several views, FIG. 1 shows a playset 10 including a number of individual buildings 12, 14 and 16. Each of the buildings has a generally rectangular base 18 with a flat bottom 20 that has generally parallel straight front and back edges 22 and 24, respectively. While a rearward portion 26 of each of the sides of the base are generally parallel to each other and substantially perpendicular to front and back edges 22 and 24, a forward portion 28 of each of the sides meets front edge 22 at an angle of about one hundred twelve and one-half degrees, as is best illustrated in FIGS. 1 and 2. Angled portion 28 is joined by a short edge 30, which is generally parallel to edges 22 and 24, to rearward portion 26 to complete the side. Edges 28 and 30 meet at a rounded corner 32. Projecting upwardly from each rounded corner 32 is a short pin 34.

Secured to and extending upwardly from one base 20 to form individual building 12 is a building facade 38 which may represent a food store or the like. Similarly, another facade 40 extends upwardly from another base 20 to form individual building 14 which is a florist or the like. Extending upwardly from yet another base 20 is a facade 42 forming individual building 16 which may be a post office or some such other civic building. Each of building facades 38, 40 and 42 is provided with simulated doors **38*a*, 40*a* and 42*a* as well as windows 38*b*, 40*b* and 42*b*, respectively. As is best illustrated in FIG. 1, each of the facades, doors and windows are conveniently of a different style as are the facades' respective roofs 38*c*, 40*c* and 42*c***.

FIG. 3 best illustrates that the interior of each facade, which is readily accessible from the back, may include shelves 44 for holding various simulated floral arrangements 46. Depending upon the theme of the building, different storage arrangements and different simulated items may be provided for enhancing play with the individual buildings.

To assist in creating a town or village, each of the individual buildings may be connected together using an additional structure of a type generally found along the streets and sidewalks of a town or village disposed between buildings. Examples of such connecting structures are shown in the illustrated embodiment as tree 50, lamp post 52 and fence 54. Mail boxes (not shown), benches (not shown), public telephones (not shown), dog houses (not shown) and other similar structures may also be used. Each of connecting structures 50, 52 and 54 has an elongated, rectangular base 56 with a pair of spaced apart holes 58 adjacent each end. Each of the holes fits snugly over one of pins 34.

In the arrangement illustrated in FIG. 1, the individual buildings are connected together using the outermost holes on base 56. If, however, it is desired to arrange the buildings in a surrounding town "square" type arrangement, adjacent angled edges 28 of individual buildings are abutted and the innermost holes on base 56 are fitted over the respective pins 34 to connect the buildings together as illustrated in FIG. 2. With angled edges 28 meeting front edge 22 at an angle of about one hundred twelve and one-half degrees, eight of the individual buildings may readily be arranged to enclose an octagon. The angle between edges 28 and 22 should not exceed more than about one hundred thirty-five degrees which permits four of the individual buildings to enclose a square.

Also included with the playset is a line of small, soft body dolls of which toy doll 60 illustrated in FIG. 1 is representative and animal figures (not shown) representing various family members, town officials and pets. Each doll and figure is distinct but they all bear a family resemblance with short nap or pile covered bodies, appendages and heads with yarn hair 62 on top of the head.

While a particular embodiment of the present invention has been shown and described, variations and modifications will occur to those skilled in the art. It is intended in the appended claims to cover all such variations and modifications as fall within the true spirit and scope of the present invention.

What is claimed as new and desired to be secured by Letters Patent is:

1. A playset comprising in combination:

a plurality of individual toy building facades;

each building facade having a different appearance and including a simulated building front and a generally flat base;

each facade extending upwardly from its respective base;

each toy building facade base having a front edge generally parallel to the simulated building front and opposed side edges;

a number of connecting structures representing things other than toy building facades and being disposed intermediate adjacent facades;

each connecting structure including a generally flat base; and means for connecting the base of one of the intermediate structures to the base of each of two adjacent facades adjacent their respective side edges.

2. The playset of claim 1 in which the connecting means includes a pin on one of the base that is received in a hole in the other base.

3. The playset of claim 1 in which at least the forward portion of the side edges meet the front edge at an angle greater than ninety degrees.

4. The playset of claim 3 in which the angle is between approximately one hundred twelve degrees and one hundred thirty-five degrees.

5. The playset of claim 2 further comprising:

a pair of spaced apart pins on one of the bases; and a pair of outermost spaced apart holes plus a pair of innermost spaced apart holes in the other base so that the bases of the two adjacent toy building facades may be selectively connected in abutting each other or spaced apart from each other.

* * * * *